United States Patent [19]

Terstegge

[11] 3,975,982

[45] Aug. 24, 1976

[54] FIREARM WITH ACCURIZING MEANS

[76] Inventor: Theodore E. Terstegge, 131 Stillings Ave., San Francisco, Calif. 94131

[22] Filed: May 31, 1974

[21] Appl. No.: 475,056

[52] U.S. Cl. ..... 89/163
[51] Int. Cl.[2] ..... F41C 3/00
[58] Field of Search ..... 89/163, 196

[56] References Cited

UNITED STATES PATENTS

| | | | |
|---|---|---|---|
| 1,427,966 | 9/1922 | Nickl | 89/163 |
| 3,380,346 | 4/1968 | Gustin | 89/196 |
| 3,411,405 | 11/1968 | Pachmayr et al. | 89/196 |

OTHER PUBLICATIONS

Jorgensen et al., "Rear Lock-Up Stabilizes .45 Pistol," American Rifleman, vol. 117, No. 8, Sept. 1969, p. 41.

*Primary Examiner*—Stephen C. Bentley
*Attorney, Agent, or Firm*—Flehr, Hohbach, Test, Albritton & Herbert

[57] ABSTRACT

A semi-automatic firearm of a type having a barrel loosely coupled with respect to a frame unit, such as the receiver of a pistol, and having a slide member disposed about the barrel and coupled to the frame or receiver unit for movement between advanced and retracted positions relative to the barrel includes accurizing means which serves to remove lost motion between the barrel and the slide where the slide carries the sights of the firearm. Lost motion is removed at the muzzle, at the breech, and in the sliding land-and-groove coupling between the slide and receiver so as to achieve repeatable, accurate performance of the firearm.

6 Claims, 8 Drawing Figures

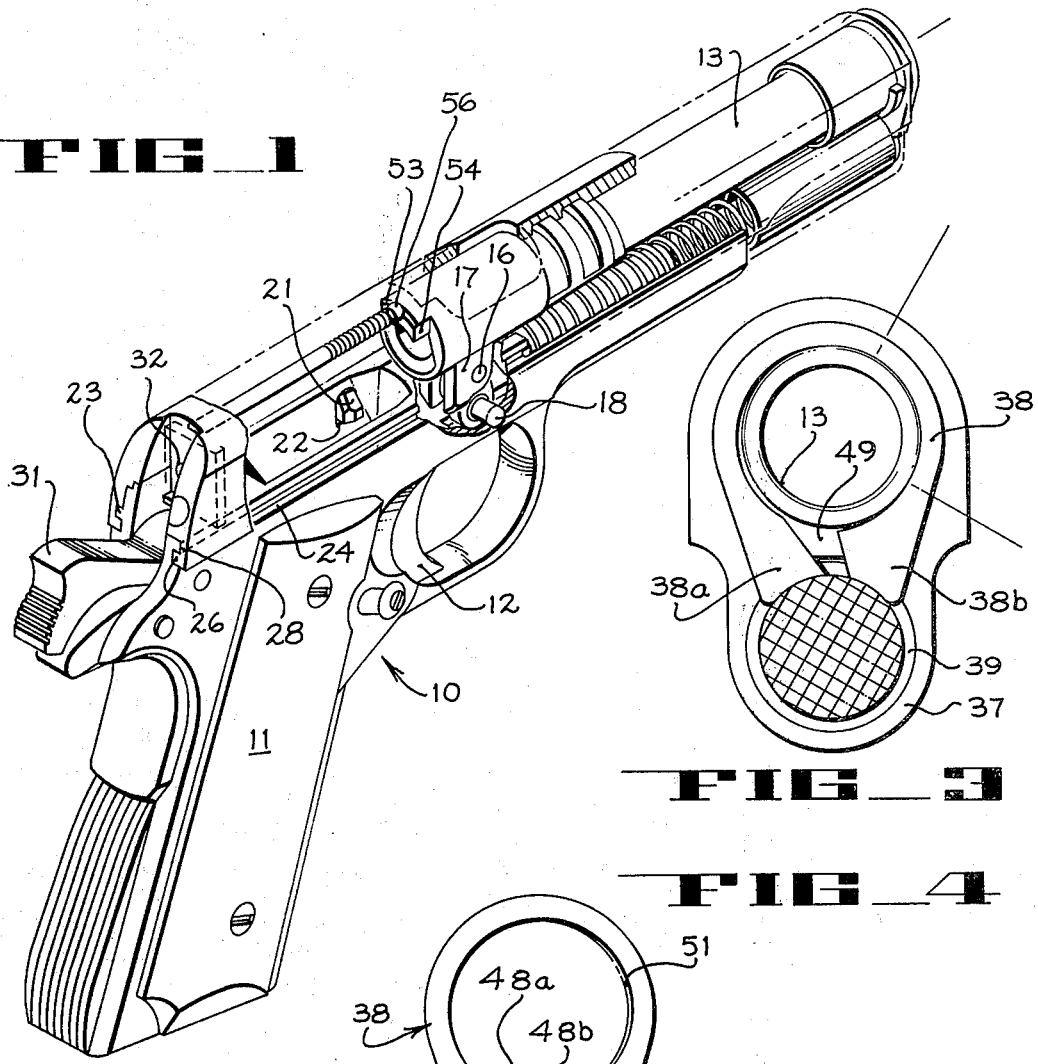
FIG_1
FIG_3
FIG_4
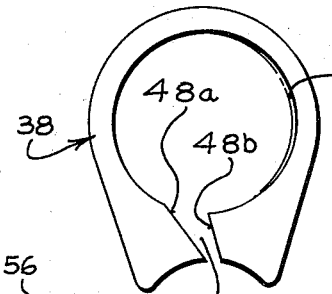
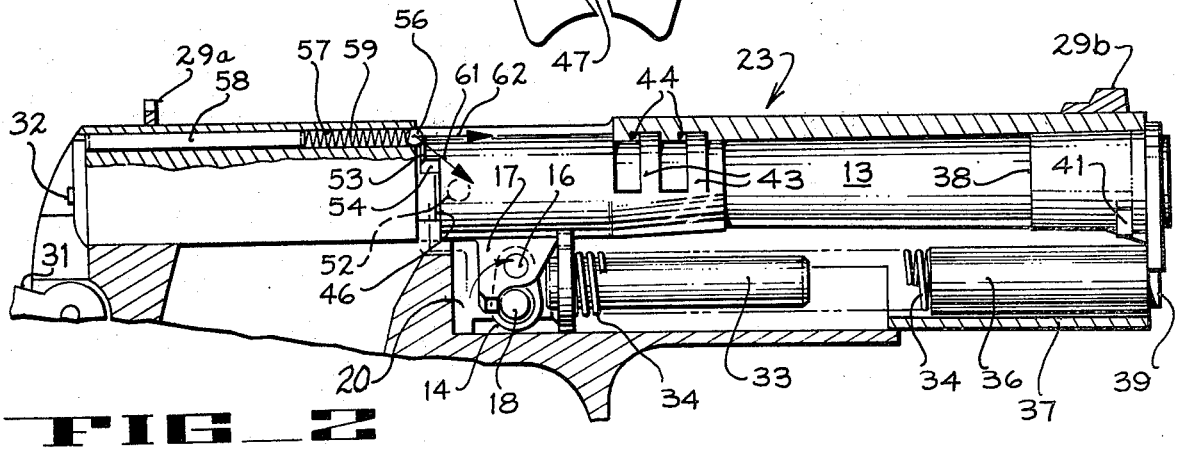
FIG_2

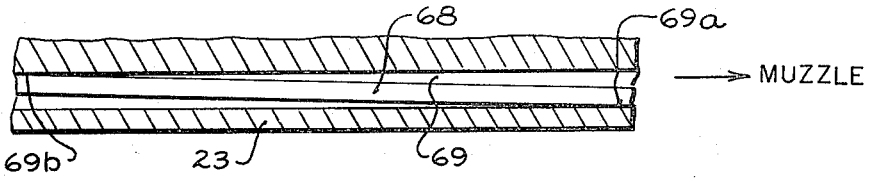
FIG_8
FIG_5
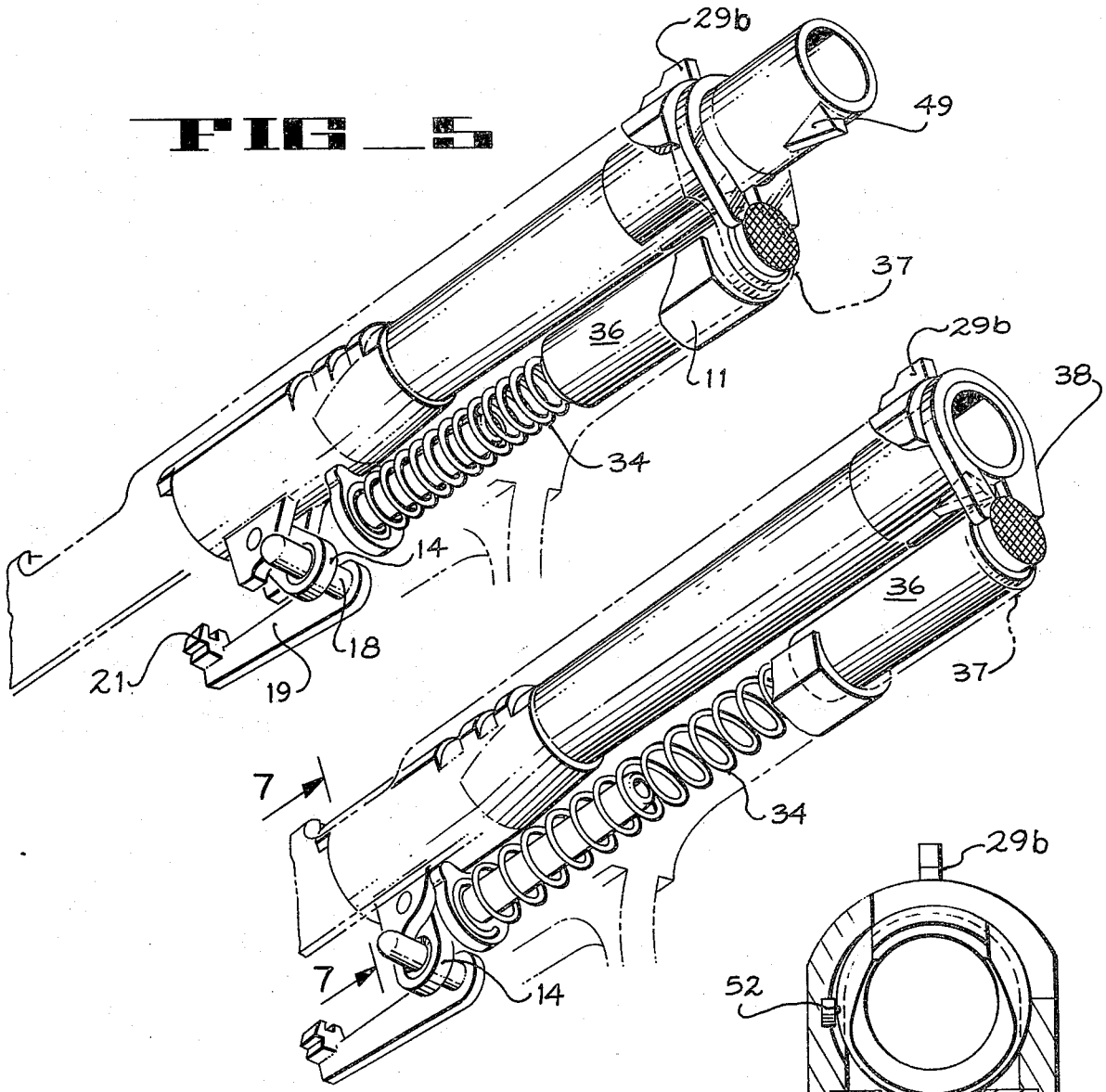
FIG_6
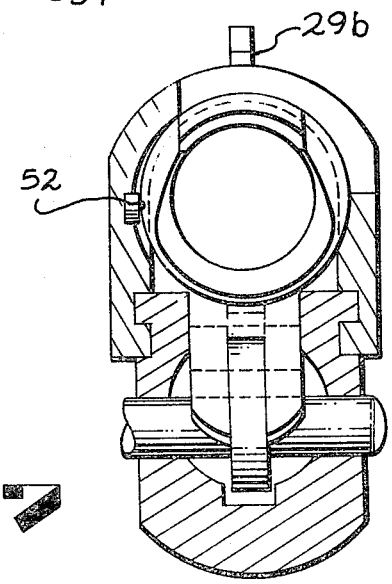
FIG_7

FIREARM WITH ACCURIZING MEANS

BACKGROUND OF THE INVENTION

This invention pertains to a firearm of a type employing a barrel loosely coupled with respect to a frame unit, such as a receiver of a pistol, and including a slide member having sights and disposed about the barrel where the slide member is also coupled to the receiver unit for movement relative to the receiver unit and barrel between recoil and battery positions. This invention is particularly useful in conjunction with accurizing a firearm wherein all of the parts fit relatively loosely so that the parts will be relatively widely interchangeable.

While the present invention is described in conjunction with the Colt .45 caliber semi-automatic pistol, it is to be understood that the invention is not to be considered as limited solely to one particular weapon.

As is known, the Colt .45 pistol is and has been one of the most reliable, useful handguns ever manufactured. The Colt .45 handgun has been widely used in all of the military services of this country where it is employed primarily as a side arm for purposes of providing the wearer with a weapon able to develop great impact upon targets which are quite close to the person carrying such weapon. In addition, this particular firearm has been virtually failsafe and foolproof by virtue of its simplicity of construction and design, its few parts, and its ease of assembly and disassembly for cleaning and repair.

The foregoing weapon was manufactured with interchangeability of parts as an important feature and, accordingly, most of the parts fit relatively loosely.

Obviously, the fact that the sights are carried by the slide and not by the barrel of the weapon make accuracy at long range very difficult, if not impossible, to achieve in view of the foregoing considerations (primarily the looseness with which the weapon is generally assembled).

Heretofore, due to the general attractiveness of the Colt .45 weapon, a number of attempts have been made to improve its accuracy and these typically have involved simply tightening of the parts. Some attempts involve use of tightly fitted pieces at the muzzle of the weapon.

It is readily evident, however, that the tighter that a barrel bushing is made to fit between the muzzle end of the barrel and slide, the greater will be the chances that the slide will stick or "freeze" when it should otherwise be returning freely under recoil. Thus, there is imposed an obvious limit to the degree of tightness which can be achieved between the barrel and slide at the muzzle of the weapon.

Another source of inaccuracy is to be found in the relatively loosely coupled mounting of the breech end of the barrel with respect to the receiver. This looseness in the region of the slide stop pin (in the Colt .45) tends to cause the breech end of the barrel to reposition itself at different positions for each well of the gun with little or no consistency. For example, the barrel extension lug 17 is disposed in a wall 20 of receiver 11 and moves between advanced and retracted positions so as to require sufficient clearance to permit such movements. This clearance permits the breech end of the barrel to move from side to side within well 20.

On additional source of looseness if found between the side edge of the barrel hood 54 and an interior surface of the slide.

Yet another source of inaccuracy is to be found in the looseness required to be permitted in the sliding coupling formed between the slide and receiver where a land-and-groove connection is made.

SUMMARY OF THE INVENTION AND OBJECTS

In general, a firearm of a type having a barrel loosely coupled with respect to a frame unit and employing a slide member disposed about the barrel for movement between retracted and advanced positions relative to the frame unit and barrel includes means for accurizing the disposition of the sights carried by the slide member with respect to the positioning of the barrel. The accurizing means includes means for removing lost motion between the barrel and slide member when the slide member moves to its advanced position. The foregoing includes a barrel bushing carried between the muzzle end of the slide member and the exterior of the barrel and cam means interposed between the barrel and barrel bushing. The cam means includes cooperating portions carried by each of the barrel and barrel bushing to provide camming engagement therebetween as the slide moves toward its advanced position so as to force the barrel to move in a predetermined direction relative to the slide for removing lost motion between the barrel and the slide.

In a particularly preferred embodiment, there is further included means forming a registration surface disposed within the slide member in a breech region thereof. The cam surface and cam are formed to cooperate in a manner serving to twist and press the barrel into engagement with the registration surface interposed between the slide and barrel so as to remove lost motion between the barrel and slide at the breech end thereof.

According to a further preferred aspect of the invention, means are provided for removing lost motion between the frame unit and the slide where the frame unit and slide employ grooves carried by one and lands carried by the other to be disposed in the grooves to permit the slide to move between advanced and retracted positions relative to the frame unit. A downwardly and rearwardly chamfered surface is formed at the breech end of the barrel. Resilient means carried by the slide engages the chamfered surface to lift the muzzle end of the slide upwardly from the receiver to register the lands and grooves tightly together at the forward and rearward ends thereof on opposite sides of the lands.

In general, it is an object of the present invention to provide a firearm with greater accuracy.

Another object of the present invention is to improve the accuracy of a pistol of a type employing a slide movable relative to a barrel and receiver by taking up much of the looseness at not only the muzzle but also at the breech end of the barrel.

A further object of the present invention is to provide a firearm of the kind described in which lost motion or looseness in the land-and-groove sliding mechanism interposed between the slide and receiver is removed when the weapon is in battery position.

The foregoing and other objects of the invention will become more readily evident from the following detailed description of a preferred embodiment when considered in conjunction with the drawings.

BRIEF DESCRIPTION OF THE DRAWINGS

FIG. 1 shows a perspective view partially cut away for clarity of a firearm according to the invention;

FIG. 2 shows a side elevation section view of the slide and barrel region of the firearm of FIG. 1;

FIG. 3 shows an end view of the firearm shown in FIG. 1;

FIG. 4 shows an enlarged detail of a barrel bushing as employed in the firearm construction of FIG. 1;

FIG. 5 shows a perspective view of a portion of the barrel, recoil spring, barrel bushing assembly in conjunction with a phantom representation of the slide and receiver positions with the weapon in a recoil condition;

FIG. 6 shows a view comparable to FIG. 5 with the slide moved to its forward or battery position;

FIG. 7 shows a transverse section view taken along the line 7—7 of FIG. 6; and

FIG. 8 shows a diagram for use in explanation herein.

DETAILED DESCRIPTION OF A PREFERRED EMBODIMENT

A firearm such as pistol 10 generally comprises a pistol grip or receiver 11 providing a frame unit. A barrel 13 is loosely coupled to receiver 11 by means of the barrel link 14 pivotally movable freely about pivot pin 16 carried between the pair of downwardly extending barrel link supports 17 formed integrally with the underside of barrel 13.

A slide stop pin 18 extends through openings (not shown) formed in the opposite sides of receiver 11 and engages barrel link 14. A detent 21 disposed on the distal end of the elongate arm 19 engages an opening 22 formed to extend through the side of receiver 11 to retain pin 18 coupled to barrel link 14 (FIG. 1).

A slide member 23 is disposed about barrel 13 and coupled to receiver 11 for movement between retracted and advanced positions relative to receiver 11 (and barrel 13). Accordingly, receiver 11 includes an elongate groove 24 adapted to be engaged by the elongate land 26 formed along the underside of slide 23 on both sides thereof. In addition, slide 23 includes a pair of grooves 27 for engaging the lands 28 of receiver 11.

Slide 23 includes longitudinally spaced sights 29*a*, 29*b* to be aligned when firing the weapon.

Firearm 10 further includes a hammer 31 conventionally released by pulling trigger 12 to strike the rear end of a firing pin 32.

Means for urging slide 23 to its battery (forward) position as shown in FIGS. 1 and 2 includes a recoil spring guide 33 inserted into one end of a recoil spring 34, a hollow recoil spring plug 36 mounted onto the other end of spring 34 and within the recoil spring plug housing 37 which is formed integrally of slide 23 to depend downwardly thereof at the muzzle end. Finally, a barrel bushing 38 carried within the muzzle end of slide 23 engages an arcuate portion of an annular shoulder 39 formed in the outer end of plug 36 so as to retain spring 34 under compression.

Means for retaining barrel bushing 38 within the muzzle end of slide 23 includes the arcuately shaped land 41 disposed to be rotated into a groove or notch (not shown) formed within the muzzle end of slide 23. Accordingly, in order to insert barrel bushing 38, it is necessary to dispose or rotate land 41 to a position disposed at the bottom of barrel 13 to permit land 41 to be moved longitudinally of barrel 13 until arrested by engagement of the transversely extending end portions 38a, 38b. At that point, bushing 38 is rotated to insert land 41 into a groove or notch contained in the removed portion of FIG. 2 and, hence, not shown therein but no different from the conventional means for retaining the barrel bushing in a Colt .45 pistol.

From the condition shown in FIG. 2 as the weapon is fired, a considerable recoil is experienced and slide 23 moves leftwardly as shown in FIG. 2. It is to be observed that a pair of arcuate ribs 43 formed across the top surface of barrel 13 lie in immediate contact with the right hand surface of grooves 44 similarly formed across the inside surface of slide 23. Accordingly, recoil of slide 23 immediately carries barrel 13 slightly leftwardly about pin 16 so that the breech end of barrel 13 is slightly lowered to disengage from slide 23 and permit slide 23 to continue to move leftwardly under recoil.

Upon return movement of slide 23 to battery position (under the force of compressed spring 34) as shown in FIG. 2, a shallow, vertically extending edge surface 46 within slide 23 engages the rear end edge of barrel 13 on both sides of slide 23 to carry barrel 13 forwardly to pivot upwardly into engagement with the locking grooves 44.

With respect to the construction described above and which is known in the prior art with the exception of the particular barrel bushing disclosed above as will be described further below, barrel 13 remains relatively loose with respect to slide 23 and, hence, also with respect to sights 29a, 29b. This looseness or lost motion is to be found both at the muzzle end of barrel 13 and also at the breech end thereof. A further location of lost motion among the parts of the construction has been observed to be located between the lands and grooves of slide 23 and receiver 11 such as 24, 26–28.

Accordingly, means for removing lost motion between barrel 13 and slide 23 as well as means for removing lost motion between receiver 11 and slide 23 have been included in the construction now to be described.

In general, the means for removing lost motion between the barrel and slide member when the slide moves to its advanced or battery position includes cam means interposed between barrel 13 and barrel bushing 38 and having portions carried by each to provide camming engagement therebetween as the slide moves toward its advanced or battery position so as to force the barrel to move in a predetermined direction relative to slide 23 and, in this way, remove lost motion between the barrel and the slide.

The foregoing movement of the barrel occurs both at the muzzle and at the breech. Accordingly, at the muzzle end of the weapon, the barrel bushing 38 includes a slot 47 formed in the generally cylindrical portion of barrel bushing 38 so as to sever the side wall thereof to define a pair of confronting free end surfaces 48*a*, 48*b*. One of the end surfaces, such as the surface 48*a*, engages a tapered cam element 49 formed integral to the muzzle end of barrel 13 whereby as slide 23 moves toward its advanced position, surface 48*a* becomes a cam-following surface for cooperation with cam 49 in providing a rotational movement to barrel 13 in a predetermined direction whereby the muzzle end of barrel 13 enters the arcuate moon-shaped portion 51 relieved from barrel bushing 38.

From the foregoing, it is readily evident that as cam 49 wedges its way between surfaces 48*a*, 48*b*, the tendency is to attempt to spread the surface 48*a* leftwardly as shown in FIGS. 3 and 4. In view of the fact that barrel bushing 38 comprises a relatively strong and only slightly resilient steel, the reaction force applied to the muzzle of barrel 13 moves the barrel muzzle into space 51 defined above. The presence of the tip end of plug 36 precludes rotation of barrel bushing 38. Accordingly, slot 47 further permits cam 49 to yieldingly spread the end surfaces 38*a*, 38*b* apart so as to preclude cam 49 from fitting so tightly within slot 47 as to impair the recoil movement of slide 23 toward its retracted position.

The foregoing action described above serves to rotate barrel 13 to the extent possible and thereby remove lost motion in the region of barrel link 14. However, the rotation applied to the muzzle of barrel 13 is insufficient to take out all of the lost motion since the looseness at the breech end of the barrel 13 exceeds the looseness at the muzzle. Therefore, a plug 52 disposed at the breech end of barrel 13 and carried by slide 23 extends radially inwardly of slide 23 to constitute a registration surface against which the breech end of barrel 13 can be twisted into engagement as slide 23 moves into battery position. Accordingly, the cam surface and cam arrangement described above are sufficient at the muzzle to twist barrel 13 and also to rotate a breech portion of barrel 13 into registration engagement with the protruding surface of plug 52 interposed between slide 23 and barrel 13 so as to remove lost motion between barrel 13 and slide 23 at the breech end as well as at the muzzle.

Means for removing lost motion in the lands and grooves intercoupling slide 23 with receiver 11 includes a downwardly and rearwardly formed chamfered surface 53 formed at the trailing edge of the barrel hood 54.

Resilient pressure means are carried by slide 23 for engaging chamfered surface 53 in a manner serving very slightly to lift the muzzle end of slide 23 upwardly from receiver 11 and to register the lands and grooves tightly together at the forward and rearward ends thereof on opposite sides of the lands.

Accordingly, a steel bearing element 56 engages surface 53 while protruding from within the elongate bored opening 57 plugged at its rear end by means of the elongate shaft-like plug 58. A spring 59 within opening 57 forces bearing element 56 to act downwardly as well as forwardly as shown by the two arrows 61, 62 respectively.

At this point in time, however, barrel 13 has been substantially rigidly coupled to receiver 11 and, it has been observed that the force attempted to be applied in the direction of arrows 61, 62 will lift the muzzle end of slide 23 and lower the rear end of slide 23 relative to receiver 11.

In the foregoing manner, the forward and rearward ends of the lands and grooves are registered tightly together to bind slide 23 to receiver 11.

Accordingly, as shown in the explanatory diagram, FIG. 8, wherein the clearance between lands and grooves has been greatly exaggerated for purpose of explanation, the leading end of the land 68 (for example corresponding to land 28 of receiver 11) makes contact with the lower side (as shown) of groove 69 at 69a. The trailing end of land 68 contacts the upper side of groove 69 at 69b whereby the forward and rearward ends of land 68 contact groove 69 on opposite sides thereof.

In the foregoing manner, any looseness in the plane of the weapon derived from the land-and-groove connection between slide 23 and receiver 11 is removed.

From the foregoing, it should be readily evident that there has been provided an improved firearm having greater accuracy than heretofore provided by removing looseness or lost motion between the barrel and slide 23 at the muzzle, at the breech, and in the sliding ways defined between the lands and grooves employed to provide a sliding member freely movable along the length of the weapon.

I claim:

1. In a firearm of a type having a barrel loosely coupled with respect to a frame unit and having a slide member disposed about said barrel and coupled to said frame unit for movement between retracted and advanced positions relative to said unit and said barrel, sights carried by said slide member, accurizing means for removing lost motion between said barrel and slide member when said slide moves to said advanced position, the last named means comprising a barrel bushing carried between the muzzle end of said slide member and the exterior of said barrel, cam means interposed between said barrel and said barrel bushing and having portions carried by each to provide camming engagement therebetween as said slide moves toward said advanced position to force said barrel to move in a predetermined direction relative to said slide for removing lost motion between said barrel and said slide.

2. In a firearm of a type having a barrel loosely coupled with respect to a frame unit and having a slide member disposed about said barrel and coupled to said frame unit for movement between retracted and advanced positions relative to said unit and said barrel, sights carried by said slide member, accurizing means for removing lost motion between said barrel and slide member when said slide moves to said advanced position, the last named means comprising a barrel bushing carried between the muzzle end of said slide member and the exterior of said barrel, said barrel bushing including a cam-following surface disposed adjacent said barrel, a cam element protruding from said barrel for engaging said cam-following surface as said slide moves toward said advanced position to force said barrel to move in a predetermined direction relative to said slide for removing lost motion between said barrel and slide.

3. In a firearm according to claim 2 further including means forming a registration surface disposed within said slide member in a breech of the slide member, said cam surface and cam being formed to cooperate in a manner serving to twist and press said barrel into registration engagement with the last named said surface interposed between said slide and barrel so as to remove lost motion between said barrel and slide at the breech end thereof.

4. In a firearm according to claim 2 in which said barrel bushing includes a radially expansible, resilient part including said cam surface formed thereon to permit said cam to expand said part and yieldingly press said barrel bushing in said predetermined direction.

5. In a firearm according to claim 2 in which said bushing includes a slot formed to sever the side wall of said bushing to define a pair of confronting free end surfaces thereof, one of said end surfaces engaging said cam as said slide moves toward said advanced position thereby defining said cam-following surface for cooperation with said cam in providing said movement of said barrel in said predetermined direction, said slot further permitting said cam to yieldingly spread said end surfaces apart so as to preclude said cam from fitting so tightly within said slot so as to impair movement of said slide to its retracted position.

6. In a firearm of a type having a barrel loosely coupled with respect to a frame unit and having a slide member disposed about said barrel and coupled to said frame unit for movement between recoil and battery positions relative to said unit and said barrel, sights carried by said slide member, accurizing means for removing lost motion between said barrel and slide member both at said muzzle and at the breech of said barrel comprising means interposed between said slide member and the muzzle of said barrel for yieldingly rotating said barrel substantially about the axis of the bore of the barrel in response to movement of said slide into battery position, and means serving to define a limit to the degree of rotation at said breech.

* * * * *